United States Patent [19]

Breuer et al.

[11] Patent Number: 4,626,034

[45] Date of Patent: Dec. 2, 1986

[54] CUTTER-BIT ASSEMBLIES

[75] Inventors: Oswald Breuer, Dortmund; Bernd Steinkuhl, Lünen; Franz Roling, Nordkirchen; Norbert Hesse; Christoph Rassmann, both of Lünen; Gunther-Dietmar Schoop, Ottmarsbocholt; Werner Höltken, Lünen, all of Fed. Rep. of Germany

[73] Assignee: Gewerkschaft Eisenhutte Westfalia, Lunen, Fed. Rep. of Germany

[21] Appl. No.: 698,520

[22] Filed: Feb. 5, 1985

[30] Foreign Application Priority Data

Feb. 8, 1984 [DE] Fed. Rep. of Germany ..... 3404295
Nov. 6, 1984 [DE] Fed. Rep. of Germany ..... 3440448

[51] Int. Cl.[4] ..... E21B 10/00
[52] U.S. Cl. ..... 299/91; 299/92; 37/142 A
[58] Field of Search ..... 299/91, 92, 93; 37/142 A

[56] References Cited

U.S. PATENT DOCUMENTS

| | | | |
|---|---|---|---|
| 2,322,929 | 6/1943 | Fulke | 299/93 |
| 3,608,218 | 9/1971 | Sturgeon | 299/92 |
| 4,267,653 | 5/1981 | Hahn et al. | 37/142 A |
| 4,455,771 | 6/1984 | Poncin | 37/142 A |
| 4,456,307 | 6/1984 | Merter et al. | 299/93 |

FOREIGN PATENT DOCUMENTS

| | | | |
|---|---|---|---|
| 880769 | 9/1971 | Canada | 37/142 A |
| 41830 | 3/1959 | Poland | 299/91 |
| 754662 | 8/1956 | United Kingdom | 299/93 |

*Primary Examiner*—James A. Leppink
*Assistant Examiner*—William P. Neuder
*Attorney, Agent, or Firm*—Sughrue, Mion, Zinn, Macpeak and Seas

[57] ABSTRACT

A cutter-bit assembly employs an arcuate wedge 16 to secure a cutter-bit 2 within a pocket 4 of a holder 1. An additional deformable insert or resilient backing piece 18 is also located in an arcuate gap between the cutter-bit shank and a curved surface of the holder. The insert or backing piece co-operates with teeth 19 to lock the wedge in position.

20 Claims, 18 Drawing Figures

CUTTER-BIT ASSEMBLIES

FIELD OF THE INVENTION

The present invention relates to cutter-bit assemblies for use in mining or tunnelling.

BACKGROUND TO THE INVENTION

Cutter-bit assemblies of various designs are widely used in mining and tunnelling operations. Normally, such assemblies are composed of a holder secured to a cutting appliance or machine, such as a coal plough, and a separate cutter-bit which is inserted into a pocket in the holder. To secure the cutter-bit within the holder it is known to employ a locking element which jams a shank of the cutter-bit in the pocket. U.S. Pat. No. 4,456,307 describes an assembly which uses an arcuate wedge as the locking element. To secure the wedge in position a deformable lug or tab can be bent around a front wall of the pocket. During use of the assembly, however, especially when the assembly is subject to impact stress, deformation and wear can cause the loosening of the wedge and the cutter-bit and chattering and damage can then occur.

The service life of the cutter-bits can be improved significantly if the means used to secure the cutter-bits in the holders is made more reliable. With this in mind the present invention seeks to provide improve cutter-bit assemblies.

SUMMARY OF THE INVENTION

According to the invention, a cutter-bit assembly comprises a holder defining an open pocket, a cutter-bit having a shank received in the pocket, an arcuate tapered gap between the shank and an inner face of the pocket and a removable arcuate tapered wedge element fitted in the gap to secure the cutter-bit in the pocket. In accordance with the invention, the wedge element co-operates additionally with retention or locking means within the gap which holds the wedge element in position. It is preferred to adopt a deformable insert or a backing piece with deflectable parts which inter-engages with a frictional and/or shape locking effect in the gap between the wedge and a curved counter-face of the cutter bit shank. The insert or backing piece is then deformed or deflected, at least partly, as the arcuate wedge is forced into the gap. Conveniently, the retention means, such as the insert or backing piece, engages or interacts with a toothed region with teeth shaped to permit easy insertion of the wedge element and to resist withdrawal of the element from the arcuate reception gap. Assemblies constructed in accordance with the invention ensure that the wedge and cutter-bit are reliably held in position even when subjected to high forces, particularly impacts, during use. Since the retention means is located in the arcuate gap which receives the arcuate wedge the retention means of whatever form is protected and not subjected to external influences. Nevertheless the cutter-bit can be removed for replacement or re-sharpening by driving the arcuate wedge out of the gap in known manner by hammer blows on the upper narrow end of the wedge either directly or via a tool.

In some embodiments of the invention an insert serving as retention means is a plug made of inexpensive synthetic plastics which is ductile and resilient. Preferably a plastics with a Shore A hardness of 80 to 100 is adopted. Although the insert can simply make frictional contact with the wedge or cutter-bit shank it is preferred to provide a serrated or toothed portion, say on the wedge or the cutter-bit shank. This serrated portion then deforms the insert to provide additional shape locking as the wedge is driven into the arcuate gap. As mentioned, the serrated portion is best fashioned with teeth shaped to provide minimal resistance to the wedge as it is driven in but maximum resistance to relative motion in the reverse direction which loosens the wedge. As the wedge is driven in the plastics material becomes upset and presses itself between the teeth to provide the aforesaid shape locking. When the wedge is removed in the manner discussed above the teeth shear off the material trapped in the gaps therebetween. The damaged insert can however be replaced. In specific constructions, the insert can be mounted to the cutter-bit shank while the wedge has the serrated portion. The insert can then be a simple cylindrical plug press-fitted into a recess such as a blind bore, in the shank to project proud of the arcuate face thereof defining the arcuate gap. The plug-like plastics insert may also contain deformable metal strips or a metal pin or tube can be press-fitted in a through bore in the insert. These strips or the pin can then become deflected and engage between a pair of teeth when the wedge is driven in.

In other constructions the plastics insert is mounted to the wedge element and the curved face of the shank has the serrated portion. The insert can in this case take the form of a block projecting from the inner and outer arcuate faces of the wedge as well as laterally to provide additional frictional locking. With such a three-zonal contact the serrated portion can in some cases be omitted.

In other embodiments of the invention, the arcuate wedge has a backing piece of similar arcuate shape fitted along its external convex arcuate face directed inside the pocket. This backing piece can be made from similar metal to the wedge and can be provided with a serrated portion to co-operate with a plastics insert on the cutter-bit shank, for example. Alternatively, the backing piece has resilient fingers which interact with a serrated portion on the cutter-bit shank and in this case the plastics insert is unnecessary. The backing piece in these designs is clamped to the wedge from the upper narrow end region of the latter and in accessible position. To release the wedge the connection with the backing piece is released and the wedge can be very easily driven out without entraining the backing piece at all.

The invention may be understood more readily, and various other aspects and features of the invention may become apparent, from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
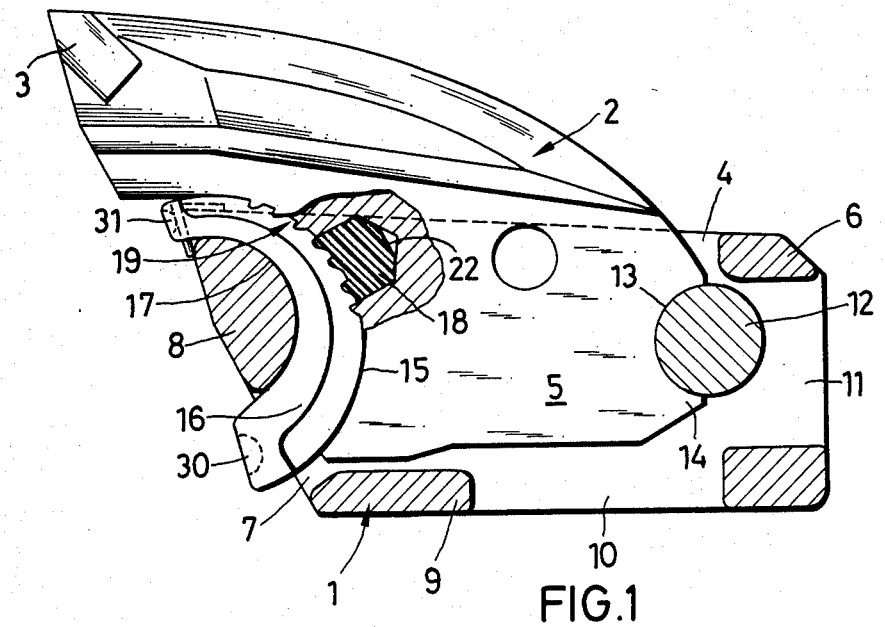
FIG. 1 is a part-sectional side view of a cutter-bit assembly constructed in accordance with the invention.
Figure 2:
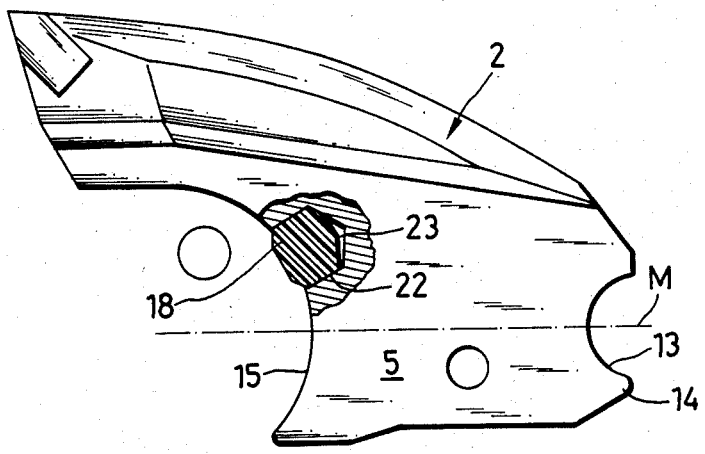
FIG. 2 is a part-sectional side view of the cutter-bit and an associated insert of the assembly shown in FIG. 1.

In the accompanying drawings, like reference numerals are used to denote like and analogous parts. In all cases a cutter-bit assembly is composed of a holder 1, a cutter-bit 2 and locking means including a wedge component or element 16 used to retain the cutter-bit 2 within the holder 1. The holder 1 is fixed or detachably mounted to some appliance, e.g. a mineral winning machine, such as a plough or shearer, or to a hewing or tunnel driving machine or to the cutting means thereof. The cutter-bit 2 is the form of a shaped metal plate with a shank portion 5 received in the holder 1 and a hard-metal insert 3 forming a cutting edge. The shank 5 of the cutter-bit 2 is located within a pocket 4 defined within the holder 1. The holder 1 is of generally rectangular configuration having a rear wall 6 provided with an aperture 11 relative to the forwardly-directed cutting edge 3 of the cutter 1. A front wall 8 of the holder 1 nearest the cutting edge 3 of the cutter-bit 2 has an opening 7 near a bottom wall 9 which itself has an additional opening 10. The rear wall 6, the front wall 8 and the bottom wall 9 of the holder 1 are interconnected with two parallel side walls. The pocket 4 is open from the top side to receive the shank 5 of the cutter-bit 2. A cylindrical pin 12 extends transversely of the pocket 4 and is disposed near the rear wall 6 and is engaged, e.g. as a press fit, in apertures in the side walls 11. The shank 5 of the cutter-bit has a substantial semi-circular recess 13 in its rear face so that when the shank 5 is inserted into the pocket 4 the face 13 can be engaged on the peripheral surface of the pin 12 and the cutter-bit 2 can be swivelled into the pocket 4 about the pin 12. The lower rear region of the shank 5 beneath the recess 13 forms a projection or nose 14 which engages in hook-like manner beneath the pin 12.

At the front end of the shank 5 opposite the recess 13, there is provided an arcuate face 15 which defines with a facing curvilinear surface 17 of the wall 8, an arcuately-tapered gap which narrows in the direction towards the upper region of the cutter-bit 2 outside the pocket 4. This gap receives a corresponding arcuate-shaped tapered wedge element or component 16. This wedge element 16 is dimensioned to fit tightly in the gap between the surfaces 15, 17 to jam the cutter-bit 2 in the holder 1. The wedge element 16 typically forms an arc of approximately 180° to 200°. The element 16 is removable via the opening 7 and thus serves to fix the cutter-bit shank 5 in the pocket 4 of the holder 1 in a detachable manner. During assembly, the shank 5 is placed into the pocket 4 from the rear with its surface 13 engaged on the pin 12. The front of the cutter-bit 2 is then swung downwards into the holder 1 and the element 16 is driven-in through the opening 7 to firmly clamp the cutter-bit 2 in the holder with a wedging action. To remove the cutter-bit 2, the wedge element 16 is driven out from the opening 7. To prevent the wedge element 16 from being loosened during cutting work, an additional complementary retention or locking means is provided, in some embodiments in the form of a deformable insert, and as described hereinafter.

Figure 3:
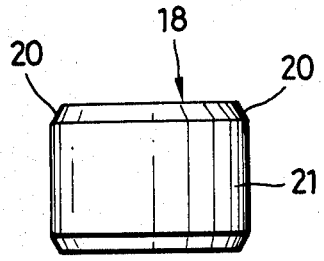
FIG. 3 depicts the insert of the assembly shown in FIG. 1.
Figure 4:
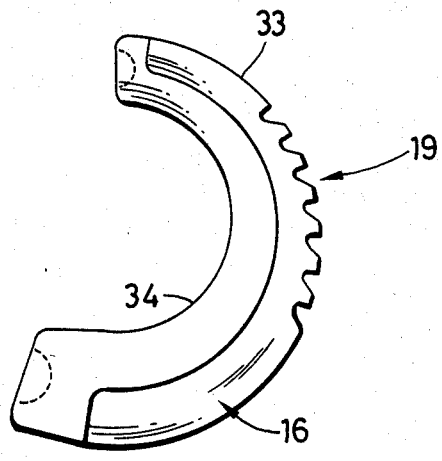
FIG. 4 is a side view of the wedge component of the assembly shown in FIG. 1.
Figure 5:
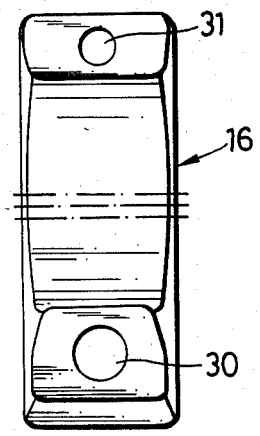
FIG. 5 is an end view of the component shown in FIG. 4.
Figure 6:
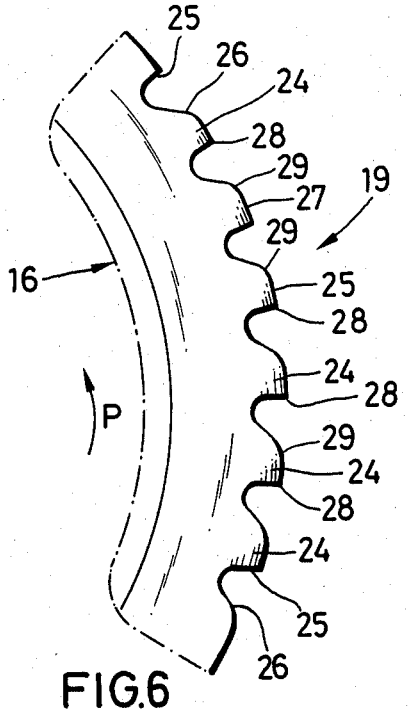
FIG. 6 is a side view of part of the component shown in FIG. 5 taken on a somewhat larger scale.

In the embodiment shown in FIGS. 1 to 6, a deformable insert 18 is provided within a recess 22 in the arcuate front face 15 of the cutter-bit shank 5. The wedge element 16 has a serrated portion 19 over its convex arcuate face as shown particularly in FIGS. 4 and 6. The insert 18 is made of a synthetic plastics material which is inherently resilient and ductile having a Shore A hardness of approximately 80 to 100 and preferably in the region of 90. A material known as 'Vulkollan' is particularly suitable. The insert 18 is made in the form of a cylindrical plug and has chamfered ends 20 as shown in FIG. 3. The chamfered ends have an angle of about 30°. The insert 18 also has a circumferentially flattened portion 21 extending almost over its entire length. Alternatively, the insert 18 could have an axially extending groove or bore or some other peripheral discontinuity. The recess or bore 22 in the shank 5 which receives the insert 18 is a blind bore having a frusto-conical inner end 23 and the insert 18 is press-fitted in the bore 22. The bore 22 is located near the zone where the shank 5 joins the upper part of the cutter-bit 2 and inclines upwardly. The bore 22 is also off-set towards the top opening of the pocket 4 relative to a plane, shown at M in FIG. 2, containing the axis of the pin 12 which defines the main clamping forces. The serrated portion 19 of the element 16 extends roughly from the central region of the element 16 to a zone which lies near the narrowest end region of the element 16. This serrated portion 19 thus only extends over a part of the wedge component 16, preferably over an arcuate angle of approximately 60° to 70°. The wedge element 16 may be a metal drop forgoing and the serrated portion 19 is then machined-in subsequently. Since the insert 18 is symmetrical it can be inserted from either end into the hole 22 and the chamfered end regions 20 facilitate the pressing of the insert into the blind bore 22. The flattened portion 21 of the insert 18 enables air to escape from the hole 22 when the insert 18 is being pressed in. The same effect would, of course, be achieved by the groove or hole or other discontinuity in the periphery of the insert 18. In the fully inserted position, the insert 18 projects from the arcuate face 15 of the shank 5 over a distance corresponding to about the length of the chamfered end region 20 and generally this projection is in the order of 0.5 mm to 1.5 mm and preferably around 1 mm. As also shown in FIG. 1, the element 16 has shallow depressions 30, 31 in its ends which receive a mandrel or punch or other tool for driving the element 16 into the arcuate gap or out from the gap with the aid of a hammer. As shown in FIG. 6, the serrated portion 19 has teeth 24 each of which is gently inclined over a front flank 26 relative to the direction indicated by arrow P, i.e. in the direction in which the element 16 is driven into the arcuate gap. The rear flanks 25 of the teeth 24 are more sharply inclined and these rear flanks 25 extend near perpendicularly to the outer side faces 27 of the teeth 24 to create sharp transition edges 28. The more gently inclined flanks 26 merge with the side faces 27 by way of a rounded regions 29. In the main, the flanks 25, 26 extend at an angle of approximately 45° relative to one another but this angle is made greater for the first tooth 24 in the row which lies next to the thin end of the element 16. The shape of the teeth 24 permits the element 16 to be displaced more easily in the direction of the arrow P relative to the projecting insert 18. As can be seen in FIG. 1, when the element 16 is driven in, the serrated portion 19 is driven into the insert 18 which is thus upset and because of its resilient material presses itself into the gaps between the teeth 24. In this way the element 16 is reliably located and prevented from working its way loose. In order to loosen the wedge element 16, to enable the cutter-bit 2 to be removed from the pocket 4, the element 16 is driven out in a direction reverse to arrow P by means of impact on the narrow upper end of the element 16. Since the teeth 24 are sharp edged at 28 in the direction in which the element 16 is removed, the material of the insert 18 located between the teeth 24 is sheared off as the element 16 progresses out of the opening 7. If the cutter-bit 2 is thus removed, say for re-sharpening, the insert 18 can be removed and easily replaced by a fresh insert 18. The wedge element 16 can however be used repeatedly.

Figure 7:
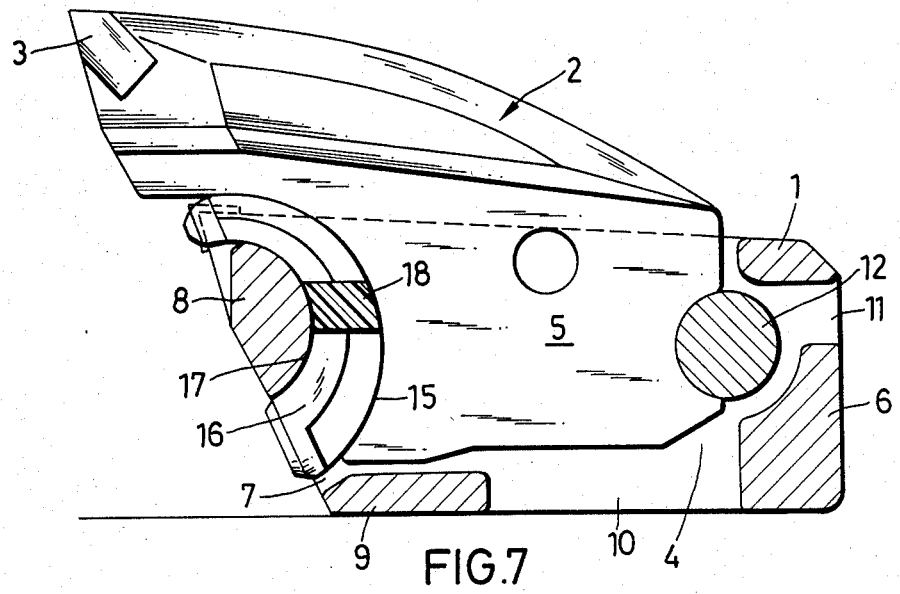
FIG. 7 is a part-sectional side view of another cutter-bit assembly constructed in accordance with the invention.
Figure 8:
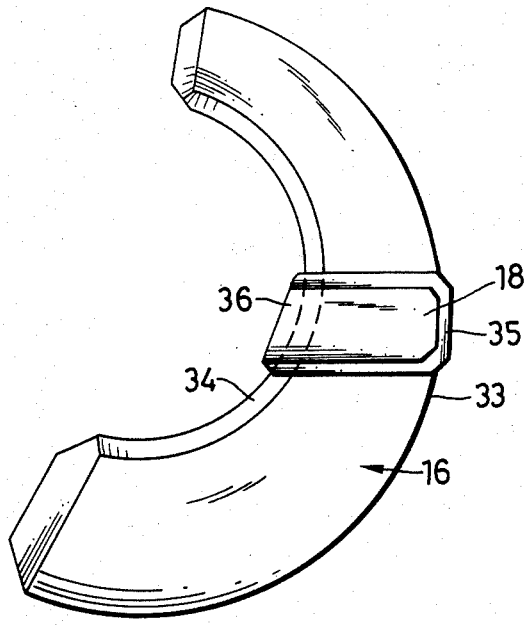
FIG. 8 is a side view of the wedge component and associated insert of the assembly shown in FIG. 7.
Figure 9:
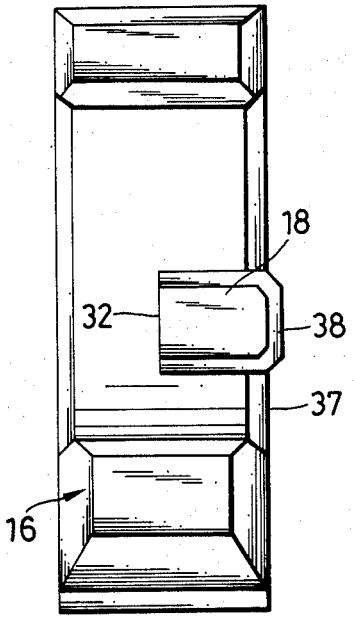
FIG. 9 is an end view of the component shown in FIG. 8.
Figure 10:
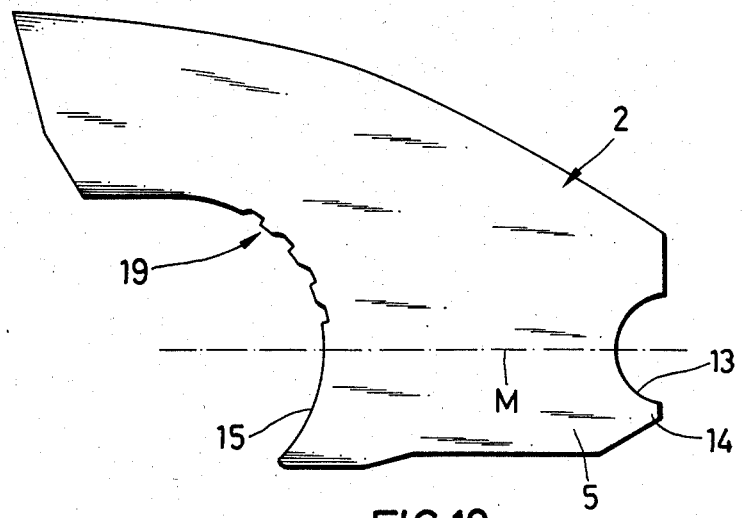
FIG. 10 is a side view of another form of cutter-bit for use in assemblies constructed in accordance with the invention.
Figure 11:
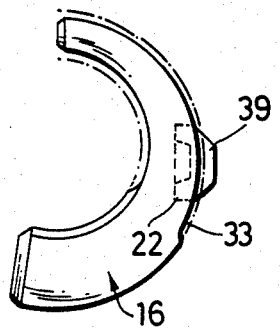
FIG. 11 is a side view of a wedge component and associated insert usable with the cutter bit depicted in FIG. 10.
Figure 12:
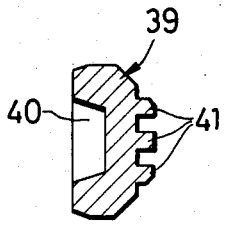
FIG. 12 is a sectional side view of insert usable with the wedge component of FIG. 11, the view being taken on a somewhat larger scale.
Figure 13:
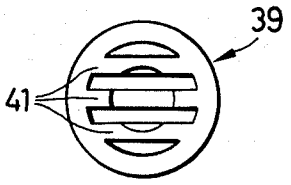
FIG. 13 is an end view of the locking insert shown in FIG. 12.
Figure 14:
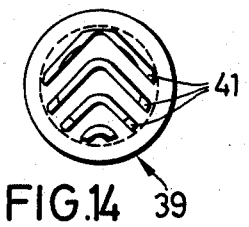
FIG. 14 is an end view of a modified insert usable with the cutter-bit shown in FIG. 10.

In the embodiment shown in FIGS. 7 to 9, locking piece or insert 18, here of block like form, is provided on the wedge element 16 instead of within the cutter-bit 2. This insert 18, which is again of synthetics plastics material, of the type mentioned, is located at about the centre of the element 16. The element 16 has a lateral recess 32 with a depth equal to approximately half the thickness of the element 16 as shown in FIG. 9. The recess 32 extends over the entire width of the element 16 (FIG. 8). The insert 18 is again retained in the recess 32 as a press fit and projects beyond the rear arcuate face 33 of the element 16 as well as the front arcuate face 32. The projecting portions of the insert 18 are designated 35, 36. In addition, the insert 18 projects laterally beyond the side face 37 of the element 16 as shown in FIG. 9 at 38. Thus when the element 16 is driven in via the opening 7 the portion 35 of the insert 18 moves into tight frictional contact with the arcuate face 15 of the cutter-bit 2 and the portion 36 moves into tight frictional contact with the arcuate face 17 of the wall 8. At the same time, the projecting region 38 is forced into the tight frictional contact with one of the side walls of the holder 1. In this way the element 16 is firmly clamped in position. In another arrangement it is possible to locate the insert 18 in a hole extending transversely through the element 16. Although the frictional contact afforded by the block insert 18 in FIGS. 3 to 9 may be sufficient of itself to hold the element 16 in position reliably it is possible to provide a serrated portion 19 as shown in the first embodiment on one of the complementary faces 15, 17 preferably the face 15, to intereact with the insert 18. Another arrangement of this latter type is shown in FIGS. 10 to 13. As shown in FIG. 10, the cutter-bit 2 has on the front arcuate face 15 of its shank 5 a serrated portion 19 corresponding generally to that shown in FIGS. 1 to 6 to be on the wedge component 16. The serrated portion 19 is located between the plane M and the zone where the shank 5 joins the exterior of the cutter-bit 2. FIG. 11 shows the associated wedge component 16 which, at a zone roughly mid-way along its arcuate rear face 33, has a recess or blind hole 22 in to which a plastics insert 39 is again press-fitted. This insert 39 takes the form of a disc shown in FIGS. 12 and 13. The insert 39 has a tapered depression 40 at its inner end and on its exterior end the insert 39 has integrally-formed ribs 41 which co-operate with the serrated portion 19 on the arcuate face 15 of the shank 5 of the cutter-bit 1 when the element 16 is driven in. As depicted in FIG. 14 the ribs 41, which are rectilinear in FIGS. 12 and 13, can be made of V or arcuate shape. It is also possible to dispense with these ribs entirely as shown in FIG. 11.

Figure 15:
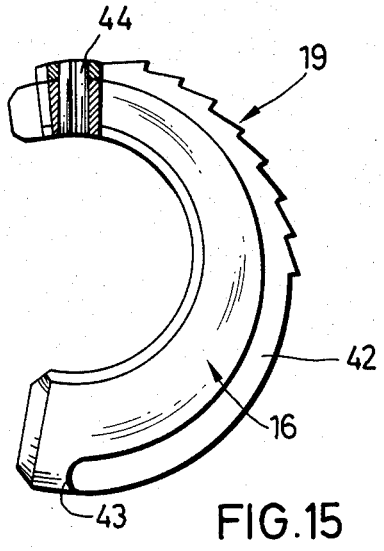
FIG. 15 is a side view of a further form of wedge component with an associated backing piece.

FIG. 15 shows an alternative arrangement where the wedge element 16 has a similar arcuate backing piece or component 42 associated therewith. The component 42 is also made of metal and forms an arcuate segment which extends around the rear of the element 16. The backing piece 42 is releasably attached to the wedge component 16 and lies in face-to-face contact with the wedge component 16 and against a shoulder 43 thereof terminating near the wider end of the wedge component 16. The backing piece 42 is releasably secured near the narrow end of the element 16 by way of a clamping sleeve 44. The sleeve 44 is introduced into aligned holes in the backing piece 42 and the wedge element 16 thereby to secure the backing piece 42 to the element 16. The backing piece 42 is provided with a serrated portion 19 as described previously. The combined wedge element 16 and backing piece 42 can be used in the assembly shown in FIGS. 1 to 6 which has the insert 18 on the front face 15 of the cutter-bit 2. Before the element 16 is driven out, when the cutter-bit 2 is being changed for instance, the sleeve 44 is released first to break the connection between the element 16 and the backing piece 42. Then, with the aid of the tool applied to the thin end of the wedge element 16, the latter can be driven out quite easily without entraining the backing piece 42. The insert 18 can thus be preserved.

Figure 16:
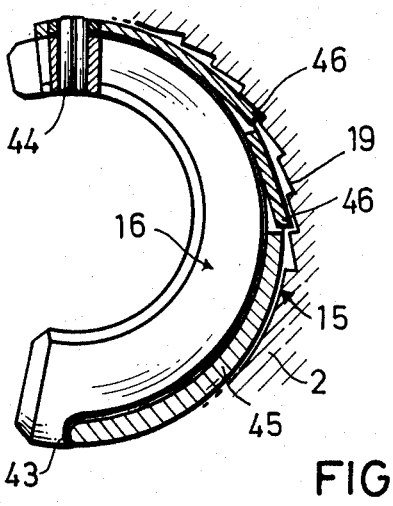
FIG. 16 is a side view of a further form of wedge component and backing piece as located to a cutter-bit.

FIG. 16 shows another modified construction in which a backing piece 45, analogous to the component 42 in the FIG. 15 construction is releasably secured to the wedge element 16 with the clamping sleeve 44 as before. This backing piece 42 has resilient outwardly-directed locking fingers 46 which are bent out from the rear of the component 42. A serrated portion 19 of sawtooth profile is provided on the arcuate face 15 of the shank 5 of the cutter-bit 2 as represented in FIG. 16. When the element 16 is driven into the arcuate gap between the curved face 17 of the wall 8 and the curved face 15 of the shank 5 of the cutter-bit 1, the resilient locking fingers 46 can easily ride over the teeth of the serrated portion 19 which act as cams. At the rear of the teeth the fingers 46 snap in the gaps between the teeth in the manner of a ratchet. In this way the wedge element 16 is reliably held in position by a shape-locking connection. In order to release the wedge element 16, the sleeve 44 is again simply released so that the element 16 can be driven out without entraining the backing piece 45.

In other constructions, the sleeve 44 shown in FIGS. 15 and 16 can be replaced by other connecting means such as pegs. The components 42, 45 which have a somewhat smaller width than the associated wedge element 16 can be engaged within a closed complementary recess at the rear of the element 16. Near the thicker end of the element 16 the backing piece 42, 45 could be located by means of a plug in connection.

Figure 17:
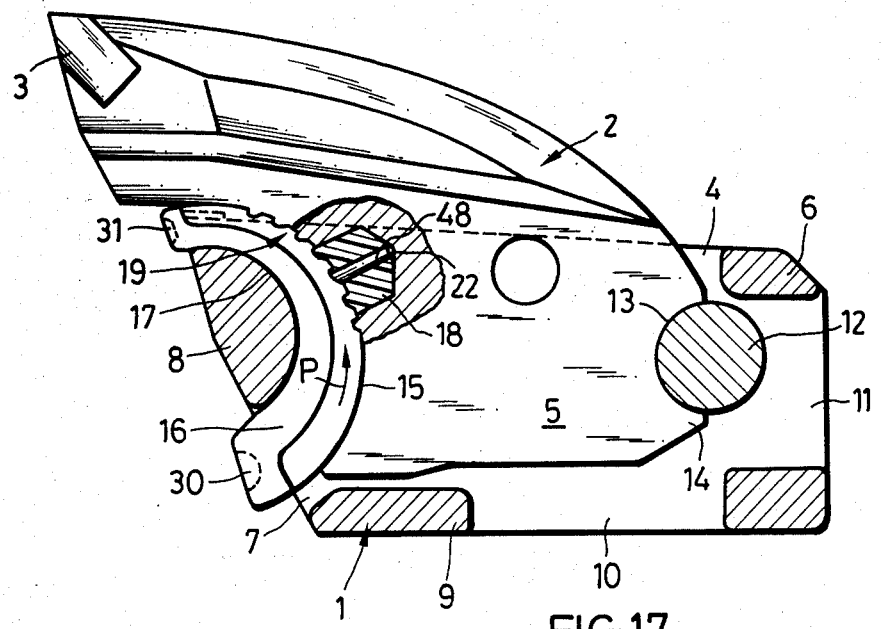
FIG. 17 is a part-sectional side view of a further cutter-bit assembly constructed in accordance with the invention.
Figure 18:
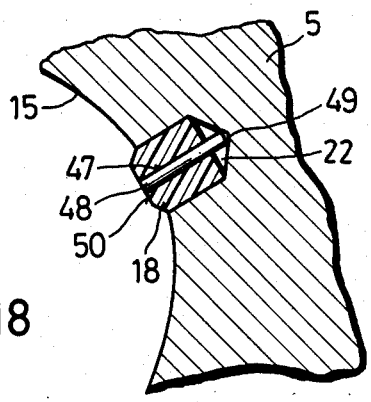
FIG. 18 is a detailed sectional view of part of the assembly shown in FIG. 17.

FIGS. 17 and 18 show a further construction which is similar to that shown in FIGS. 1 to 6. This assembly differs from those described previously in that it utilises a metal pin 48 which extends through the plastics insert 18 and is held as a press-fit within a through bore 47 in the insert 18. The insert 18 is again made from a hard, yet ductile plastics material and the metal pin 48 is preferably made from steel. As shown particularly in FIG. 18, the length of the pin 48 is somewhat greater than the depth of the hole 22 in the shank 5 which receives the insert 18 so that the inner end of the pin 48 bears against the lower region 49 of the hole 22. In the undeformed condition illustrated in FIG. 18, the insert 18 projects from the hole 22, while the outer end of the pin 48 is flush with the outer face 50 of the insert 18. If the wedge element 16 is driven into the arcuate gap in the direction shown by arrow P in FIG. 17 the insert 18 is forced back into the hole 22 by the serrated portion 19 of the element 16. The plastics material is initially slightly displaced in the direction of arrow P while the metal pin 48 held against the bottom 49 of the hole 22 is made to assume a slightly inclined position so it can be more easily overridden by the passage of the teeth of the serrated portion 19. The particular shape of the teeth 24 as described in connection with FIG. 6 makes it possible for the teeth 24 to override the pin 48 without difficulty when the element is being driven in the direction of arrow P. When the element 16 has been firmly driven in, the pin 48 engages with its outer end in the gap between two adjacent teeth 24 of the serrated portion 19. At the same time the plastics material of the insert 18 is squeezed into the gaps between the teeth of the serrations 19 as shown in FIG. 17. The element 16 is thus prevented from being released and loosened inadvertently by the frictional locking and the shaped locking of the plastics material of the insert 18 and by a shape locking with the metallic pin 48. Even if the plastics material, which has been squeezed into the gaps between the teeth of the serrated portion 19 begins to be sheared off by load forces the wedge 16 can still be held by virtue of the pin 48. To remove the cutter-bit 2, the element 16 is driven out in the reverse direction to arrow P by hammer blows on its upper end. During this operation the plastics material of the insert 18 is first displaced in the direction opposite to that indicated by arrow P and then shears off over the portions squeezed in the gaps between the teeth of the serrated portion 19. When this happens the pin 48 is forced to assume a position slightly inclined to the axis of the hole 22 and is no longer properly engaged in the gap between two of the teeth of the serrated portion 19. Further hammer blows on the thin end of the wedge 16 will then result in deformation and eventually shearing of the outer end of the pin 48 in the gap between the teeth.

Instead of using a metal, for example a steel, for pin 48, a tube or other metallic elements such as thin strips can be embedded or moulded into the insert 18 to achieve the same or a similar effect.

We claim:

1. A cutter-bit assembly, comprising: a holder (1) defining an open pocket (4), a cutter-bit (2) having a shank (5) detachably mounted in the pocket, an arcuate tapered gap formed between the shank and an inner face (17) of the pocket, bearing means (12, 13) between the shank and the holder opposite the gap, a removable tapered wedge element (16) fitted in the gap, the wedge element and the shank forming first and second complementary components, an insert (18) made from deformable plastics material removably carried by one of the complementary components and having an exterior portion extending outwardly from a surface of said one component, and a serrated metallic portion (19) on the other of the components disposed in direct contact with said exterior portion of the insert, said exterior portion being deformed by the serrated metallic portion and lodging in gaps between adjacent serrations to frictionally shape lock the wedge element in the gap and thus lock the cutter-bit in the pocket.

2. An assembly according to claim 1, wherein the plastics material is resilient and ductile.

3. An assembly according to claim 1, wherein the plastics material has a Shore A hardness of 80 to 100.

4. An assembly according to claim 3, wherein the Shore A hardness of the plastics material is 90.

5. An assembly according to claim 1, wherein the insert is a cylindrical plug with at least one chamfered end region (20) which is press-fitted into the shank of the cutter-bit and projects therefrom.

6. An assembly according to claim 1, wherein the serrated portion has teeth (24) shaped to permit easier passage of the wedge element into the gap then out from the gap.

7. An assembly according to claim 6, wherein the teeth are inclined in the direction in which the wedge element is driven in, each tooth having a side flank (27), a gently inclined front flank (26) relative to the driving-in direction, and a more sharply inclined rear flank (25), the rear flank merging with the side flank at a sharp edge (28) and the front flank merging with the side flank over a portion (29) with a smoothly rounded profile.

8. An assembly according to claim 7, wherein the rear flanks of the teeth extend at an angle of approximately 90° relative to the side flanks, and the front flanks extend at an angle of approximately 45° relative to the side flanks.

9. An assembly according to claim 1, wherein the insert is combined with one or more deformable metal components.

10. An assembly according to claim 1, wherein the bearing means comprises a recess (13) in a rear face of the shank opposite the arcuate gap, and a transverse pin (12) disposed in the pocket to engage with said recess.

11. A cutter-bit assembly according to claim 1, wherein the insert is carried by the shank and the serrated portion is on the wedge element.

12. An assembly according to claim 11, wherein the insert is fitted into a recess (22) in the shank and projects slightly outwardly therefrom into the gap.

13. An assembly according to claim 12, wherein the recess is a blind-hole with a tapered bottom.

14. An assembly according to claim 11, wherein the insert is in the form of a cylindrical plug with at least one peripheral discontinuity which is press-fitted in a recess in the shank.

15. An assembly according to claim 14, wherein the recess in the shank is disposed in a position offset from a central longitudinal axis (M) of the shank passing through the bearing means towards the region of the cutter-bit outside the pocket, and the serrated portion on the wedge element extends from approximately the center of the surface of the wedge element facing the shank to terminate at a region spaced from the narrowest end of the wedge element.

16. A cutter-bit assembly according to claim 1, wherein the insert is carried by the wedge element and the serrated portion is on the shank.

17. An assembly according to claim 1, wherein the insert also has a metallic component (48) therein which also cooperates with the serrated portion.

18. An assembly according to claim 1, wherein the insert projects from the one component by an amount in the range 0.5 to 1.55 mm.

19. An assembly according to claim 1, wherein the insert is substantially plain.

20. A cutter-bit assembly, comprising: a holder (1) defining an open pocket (4), a cutter-bit (2) having a shank (5) detachably mounted in the pocket, an arcuate tapered gap formed between the shank and an inner face (17) of the pocket, bearing means (12, 13) between the shank and the holder opposite the gap, a removable tapered wedge element (16) fitted in the gap, the wedge element and the shank forming first and second complementary components, an insert (18) made from deformable plastics material removably carried by one of the complementary components, and a serrated metallic portion (19) on the other of the components which directly contacts the insert and deforms the latter as the wedge element is driven into the gap to cooperate therewith and lock the cutter-bit in the pocket, wherein the insert is a cylindrical plug containing a steel pin or tube (48), the plug being fitted into a blind bore in the shank with the pin or tube supported on an interior surface of the bore and being engageable with the serrated portion of the wedge element.

* * * * *